United States Patent [19]

Unger et al.

[11] 4,408,967

[45] Oct. 11, 1983

[54] PISTON CYLINDER AND HEAD FOR COMPRESSORS

[75] Inventors: Herbert Unger, Springe; Gunther Meise, Hanover, both of Fed. Rep. of Germany

[73] Assignee: WABCO Fahrzeugbremsen GmbH, Hanover, Fed. Rep. of Germany

[21] Appl. No.: 238,287

[22] Filed: Feb. 25, 1981

[51] Int. Cl.[3] ..... F04B 21/02

[52] U.S. Cl. ..... 417/571; 417/311; 137/512.3

[58] Field of Search ..... 417/571, 307, 311; 137/538, 512, 512.3, 512.5

[56] References Cited

U.S. PATENT DOCUMENTS

| | | | |
|---|---|---|---|
| 2,571,820 | 10/1951 | Bogdan | 417/571 |
| 2,812,893 | 11/1957 | Cotter | 417/307 |
| 3,847,513 | 11/1974 | Foster | 417/571 |
| 4,171,712 | 10/1979 | DeForrest | 137/538 |

*Primary Examiner*—Alan Cohan
*Assistant Examiner*—John A. Rivell
*Attorney, Agent, or Firm*—R. S. Visk

[57] ABSTRACT

A piston cylinder and head arrangement for compressors including a valve plate disposed between a piston housing and the head. An intake valve, a discharge valve, and an atmospheric vent valve are all operably disposed in the valve plate, and are all arranged relative to each other and relative to an intake chamber, a compression chamber, and cooling chambers so as to necessitate only one sealing gasket for sealing said valves and said chambers from each other during certain operational phases of the compressor. The arrangement further includes a piston operable responsively to discharge pressure in excess of a certain high degree for diverting such pressure output from the pressure discharge valve to the atmospheric vent valve until such pressure drops below the certain high degree.

7 Claims, 2 Drawing Figures

PISTON CYLINDER AND HEAD FOR COMPRESSORS

BACKGROUND OF THE INVENTION

In the case of piston cylinders, cylinder housings either having a smooth outer surface or provided with cooling fins can be used. With respect to the type with smooth housings, it is not likely that foil-type valves are used because of the absence of the contact surface necessary for foils. Therefore, usually disk valves are installed which are more expensive and whereby, a lesser efficiency of the compressor has to be accepted. Aside from that, disk valves are only suitable for compressors with low to medium rotational speed.

In some of the presently known compressor piston cylinder heads, such parts as the cylinder housing, the valve plate, and the cylinder head are cast in one piece. Since this arrangement requires that the cylinder head be open for installation of the foils, a cylinder head cover, having an intake connection is used as a valve seat for the intake valve and as a valve stop for the discharge valve. Such a cylinder head cover is equipped with cross pieces and hollow spaces forming the intake chamber, the discharge chambers, and the cooling chambers, so that a number of sealing gaskets are necessary between the discharge chambers and the cooling chambers, as well as between the chambers and atmosphere. Said sealing gaskets are located on several surfaces of the cylinder head according to the situations in which sealing problems exist.

SUMMARY OF THE INVENTION

The object of the present invention is to provide a piston cylinder head for compressors, whose cylinder housing is of the smooth surface type, and the gaskets for which are located on a common surface in a manner which prevents complications, so that use of a simple flange packing material is possible.

Due to separation of the one-piece piston cylinder unit into the several parts, while keeping the advantages achieved in the previously mentioned cylinder head unit, especially the advantages whereby both valves are in the form of foil valves which can be installed from the same side, and the sealing surfaces of the cylinder head chambers can be located on one surface, one below the other, as well as sealing off atmosphere, so that for sealing purposes only a one-piece flat gasket ring is necessary.

Further characteristics of the invention include a hole drilled through the valve plate through which the compression pressure acts on the intake foil valve from the bottom in such a way as to minimize the closing time reaction of the intake foil.

DESCRIPTION AND OPERATION

Figure 1:
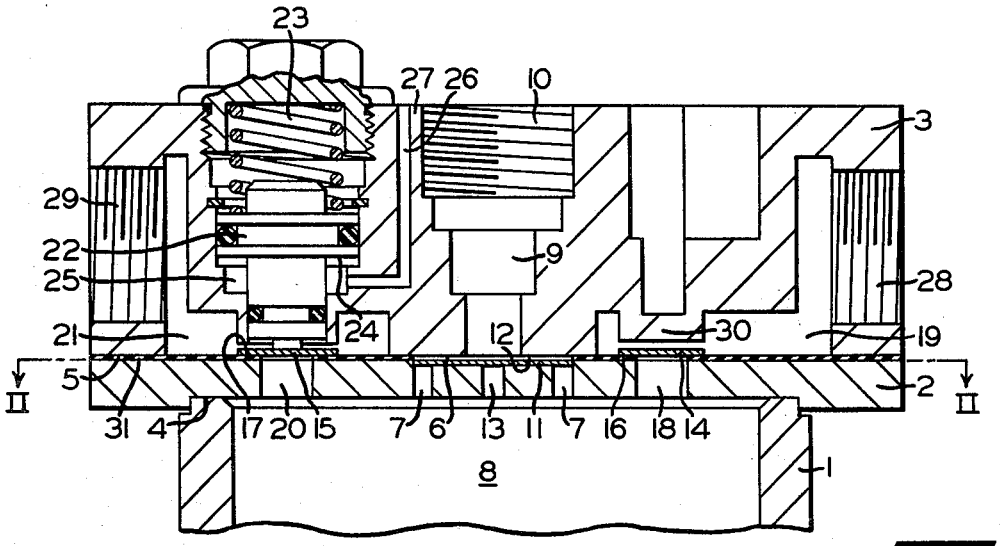
FIG. 1 is an elevational view, in section, of a compressor cylinder head embodying the invention.
Figure 2:
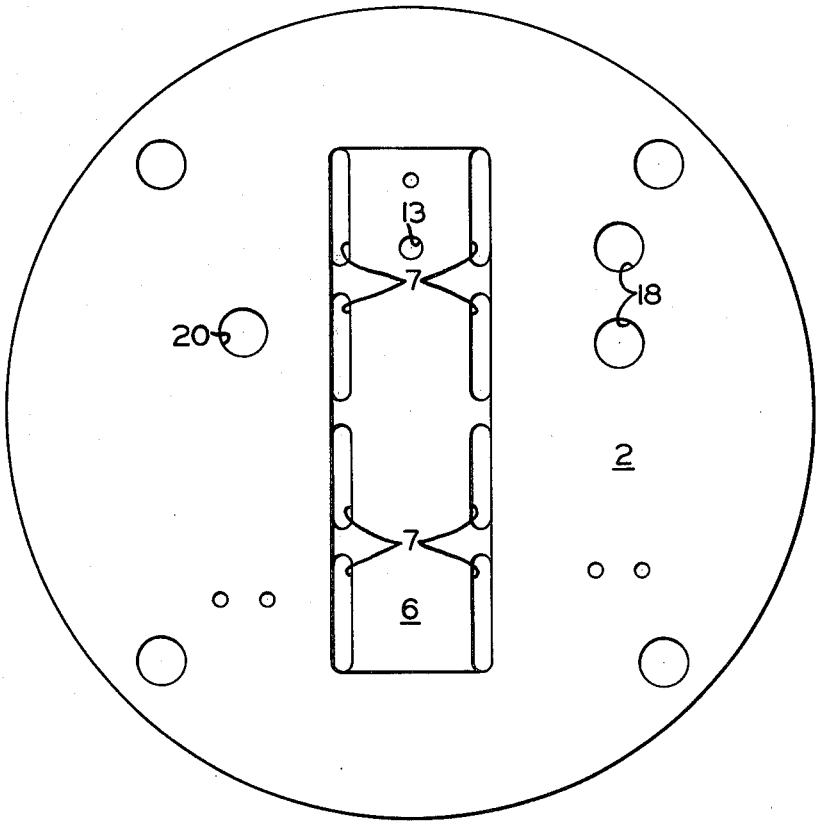
FIG. 2 is a horizontal view, in outline, of the valve plate of the device taken along a line II—II and viewed in the direction indicated by the arrows.

A piston cylinder unit embodying the invention, as shown in FIGS. 1 and 2, comprises a smooth external surface cylinder housing 1, a valve plate 2, and a cylinder head 3, whose sealing surfaces are indicated at 4 and 5. Securing means, such as bolts (not shown), secure the three parts 1, 2, and 3 onto the crank housing portion of the compressor, also not shown. A valve stop 6 is operably disposed into the upper surface of valve plate 2 as an opening, and around this valve stop 6 are situated side slits 7 which provide communication between a compression chamber 8, adjacent the under side of valve plate 2, and an intake chamber 9, located above valve plate 2. Intake chamber 9 is connected via an opening 10 with atmosphere. A foil 11 located above the valve stop 6, with a valve seat 12 of the cylinder head 3, forms an intake valve 11–12, which is opened during the air intake phase of the compressor and establishes a communication between intake chamber 9 and the compression chamber 8. A hole or intake passageway 13, extending transversely through valve plate 2, is located between side slits 7 in such a way, that the lower surface of foil 11, can be acted upon by air pressure in compression chamber 8.

The upper surface of valve plate 2 carries two foils 14 and 15, which form a discharge valve 14–16 and a pressure-control or vent valve 15–17 with the cooperation of seats 16 and 17 of valve plate 2. A plurality of drill holes or discharge passageways 18 formed transversely in valve plate 2, cooperate with discharge valve 14, when open, to provide a communication between compression chamber 8 and a pressure delivery chamber 19 formed in cylinder head 3, while a drill hole or vent passageway 20 formed transversely in valve plate 2, cooperates with pressure control valve 15–17, when open, to provide a communication between compression chamber 8 and a vent pressure control chamber 21 also formed in the cylinder head 3.

Above the pressure control valve 15–17, an operating piston 22 is located, reciprocably guided in the cylinder head 3, and biased by a spring 23 onto valve foil 15. This causes cut-off of communication between pressure control chamber 21 and compression chamber 8 if the opposing pressure in compression chamber 8 is less than a certain minimum pressure sufficient for overcoming spring 23. An annular surface 24 formed by an undercut portion of piston 22 forms a pressure surface open to an annular chamber 25, which is connected, via a passageway 26 and a connection 27 in the cylinder head 3, via a conduit, with a control valve (not shown) controlling the operating pressure of the equipment, also not shown.

A discharge or delivery opening 28 connecting with pressure chamber 19 may be connected to a pressure conduit leading to respective pressure-operable devices or to a pressure storage reservoir, while an opening 29 opens to the pressure control chamber 21 is reserved for ventilation of said pressure control chamber.

The functional operating sequence is as follows: During a return stroke of the piston, an under pressure develops within compression chamber 8, whereby the intake valve foil 11 is unseated from its seat 12.

Outer air is drawn into compression chamber 8 via opening 10, intake chamber 9, past open intake valve 11–12, and through side slits 7. During this air intake phase, the valves 14, 16, and 15 seal off delivery chamber 19 and vent chamber 21. During the compression stroke of piston 22 in compression chamber 8 and as long as pressure in said compression chamber is less than the certain minimum pressure, above defined, valve foil 11 is pressed against seat 12 and seals off compression chamber 8 from atmosphere at opening 10. At the point of exceeding the certain minimum pressure, discharge valve foil 14 is lifted off its seat 16, the opening stroke of said foil, however, being limited by a stop element 30 formed in cylinder head 3 and with which said foil makes contact after a certain amount of opening. Compressed air may then flow into delivery chamber 19 and via opening 28 to the pressure operable devices and/or the storage reservoir.

At a certain pressure level, fixed by a control valve (not shown), said control valve switches over and causes compressed air, via connection 27 and passageway 26 of the cylinder head 3, to be directed into annular chamber 25. With such pressure acting on annular surface 24, operating piston 22 is lifted against the opposing force of spring 23 to allow pressure control valve 15–17 to be unseated. This valve 15–17 now takes over the function of discharge valve 14–16 because valve 14–16 is closed by counter pressure from the pressure operable devices. The air now escapes through pressure control chamber 21 and opening 29. If the stored pressure in the storage reservoir (not shown) has built up to a certain maximum pressure level, as regulated by the control valve (not shown), said control valve again switches flow over into a direction toward the storage reservoir, the pressure of the annular chamber 25 decreases so that spring 23 becomes effective for causing piston 22 to move downwardly and thereby close pressure control valve 15–17, so that discharge valve 14–16 resumes its primary function.

In regard to the above-described solution in connection with the use of smooth surface cylinder housings and foil valves for all valves of the compressor, and at the same time the simplification of the sealing arrangement, whereby sealing means, located on one surface, is replaced by a simple flat gasket 31, an advantageous method of installing all valves on the larger surface of the valve plate facing the cylinder head results, in spite of separating the several parts. Here a solution is possible, whereby the cylinder housing and the valve plate form one part, so that only a gasket between the valve plate and the cylinder head is necessary. The passageway 13 in the valve plate 2 located between the side-suction slits 7 of the intake valve 11–12 as a further development of the invention, affects faster closing of the intake valves through the excess pressure created by the upward stroke of piston 22.

However, foil 11 of intake valve 11–12, without this control passageway 13, and after completion of the upward stroke of piston 22, that is, after completion of the suction effect due to their internal tension, also moves back to a seated position on valve seat 12. This movement, however, is subject to a certain delay due to the slow nature of the foil material. By providing the above-described control passageway 13, a delay is largely prevented.

Having now described the invention, what we claim as new and desire to secure by Letters Patent, is:

1. A piston cylinder and head arrangement for compressors comprising:

(a) a piston cylinder housing;

(b) a cylinder head;

(c) a valve plate secured between said cylinder housing and said cylinder head;

(d) said cylinder head having formed therein at least one intake chamber open to atmosphere, at least one discharge chamber provided with at least one discharge outlet and at least one atmospheric chamber provided with at least one atmospheric opening;

(e) an intake valve operably disposed adjacent one side of said valve plate;

(f) a discharge valve operably disposed adjacent said one side of said valve plate;

(g) an atmospheric vent valve operably disposed adjacent said one side of said valve plate;

(h) a sealing gasket disposed between said valve plate and said cylinder head for sealing said atmospheric chamber from said intake chamber and said intake chamber from said discharge chamber and for providing a valve seat for said discharge valve and said vent valve;

(i) said valve plate having formed therein intake passage means for communicating between said intake chamber and a compression chamber formed in said cylinder housing upon operation of said intake valve to an open position coincidental with air intake by the compressor, a discharge passageway via which said compression chamber may be communicated with said discharge chamber upon operation of said discharge valve to an open position responsively to discharge pressure coincidental with pression operation of the compressor and a vent passageway via which said compression chamber may be communicated with said atmospheric chamber, and (j) piston means operably disposed in said cylinder head for controlling said vent valve to an open position when said discharge valve and said intake valve are closed and to a closed position when either said discharge valve or said intake valve are open, said piston means being effective according to a predetermined pressure reached in said compression chamber.

2. A piston cylinder and head arrangement, as set forth in claim 1, wherein said valves are in the form of foils and are disposed on the side of the valve plate facing the cylinder head.

3. A piston cylinder and head arrangement according to claim 1, further characterized by a valve stop formed on the valve plate for limiting opening movement of the intake valve.

4. A piston cylinder and head arrangement according to claim 1, wherein said intake passage means comprises two parallel rows of elongated slits formed in and extending transversely through said valve plate with the intake valve controlling intake air flow therethrough.

5. A piston cylinder and head arrangement according to claim 1, wherein said piston means comprises:

(a) a vent control chamber formed in the cylinder head and open to atmosphere;

(b) a piston operably disposed in the cylinder head with a lower end thereof in contact with said atmospheric vent valve;

(c) a spring acting on said piston for biasing the piston and said vent valve in one direction toward a closed position of the vent valve in which communication between said compression chamber and atmosphere is cut off, (d) said piston having a pressure area subjectable to discharge pressure and movable responsively thereto, when discharge pressure exceeds a certain value, in a direction opposite to said one direction for lifting the piston off the vent valve which may be operated to an open position in which the compression chamber is communicated with atmosphere.

6. A piston cylinder and head arrangement according to claim 1, wherein the cylinder head has a stop member formed thereon for limiting the amount of opening movement of the discharge valve.

7. A piston cylinder and head arrangement according to claim 1, further characterized by a control passageway means formed in said valve plate for assisting said intake valve to the closed position by communicating said compression chamber to a portion of said intake valve adjacent said one side of said valve plate.

* * * * *